US008186654B2

(12) United States Patent
Klingspor

(10) Patent No.: US 8,186,654 B2
(45) Date of Patent: May 29, 2012

(54) SIEVE TRAY FOR USE IN GAS TREATMENT TOWERS

(75) Inventor: Jonas Klingspor, Austin, TX (US)

(73) Assignee: URS Corporation, Austin, TX (US)

( * ) Notice: Subject to any disclaimer, the term of this patent is extended or adjusted under 35 U.S.C. 154(b) by 687 days.

(21) Appl. No.: 12/283,291

(22) Filed: Sep. 10, 2008

(65) Prior Publication Data

US 2009/0102074 A1 Apr. 23, 2009

Related U.S. Application Data

(60) Provisional application No. 60/993,698, filed on Sep. 12, 2007.

(51) Int. Cl.
*B01F 3/04* (2006.01)

(52) U.S. Cl. ..... 261/114.1; 261/114.5

(58) Field of Classification Search ..... 261/113, 261/114.1, 114.3, 114.5
See application file for complete search history.

(56) References Cited

U.S. PATENT DOCUMENTS

| | | | | | |
|---|---|---|---|---|---|
| 1,686,542 | A | * | 10/1928 | Winkler et al. | 261/114.1 |
| 2,091,349 | A | * | 8/1937 | Bergman | 261/114.2 |
| 2,225,390 | A | * | 12/1940 | Ostergaard | 261/114.2 |
| 2,338,928 | A | * | 1/1944 | Glitsch | 261/114.1 |
| 2,391,464 | A | * | 12/1945 | Larsen | 261/114.2 |
| 3,013,782 | A | * | 12/1961 | Glitsch | 261/114.4 |
| 3,125,614 | A | * | 3/1964 | Mayfield et al. | 261/114.3 |
| 3,693,948 | A | * | 9/1972 | Kloss | 261/114.2 |

* cited by examiner

*Primary Examiner* — Charles Bushey
(74) *Attorney, Agent, or Firm* — DuBois, Bryant & Campbell, LLP; William D. Wiese

(57) ABSTRACT

A sieve tray is used in a gas treatment tower, wherein the tray openings are hexagonal in shape, enabling a higher open area in the tray while maintaining the tray structural integrity, thereby enabling use of the tray in higher velocity towers.

4 Claims, 2 Drawing Sheets

56% Open Area Tray

50% Open Area Tray

56% Open Area Tray

50% Open Area Tray

SIEVE TRAY FOR USE IN GAS TREATMENT TOWERS

RELATED APPLICATION

This application claims priority from U.S. provisional patent application Ser. No. 60/993,698, filed on Sep. 12, 2007.

FIELD OF INVENTION

This invention relates generally to gas treatment towers, and more specifically relates to the sieve trays that are commonly used in these towers to facilitate contact between a gas which flows in a given direction in the tower and a countercurrent flowing liquid or slurry which interacts with the gas.

BACKGROUND OF INVENTION

Gas treatment towers typically are used to effect contact between a gas or gases which are to be subjected to treatment with a liquid or slurry which reacts with the gas or a component of the gas. The gas or gases are made to flow in a first direction in the tower while the liquid or slurry reactant flows in the opposed or counter-current direction. In a typical example a sulfur-containing flue gas may be subjected in such a tower to flue gas desulfurization ("FGD") by being contacted with calcium carbonate slurry. However the present invention is not limited to use with any specific type of gas treatment tower; thus it can as well be used in various gas-liquid towers, including distillation columns and the like.

One or more perforated plates—so-called "sieve trays"—are commonly mounted in the tower flow path to serve as liquid-gas contact surfaces facilitating the liquid-gas reaction. (As used herein it will be understood that the term "liquid", as in "gas-liquid contact", is intended to encompass not only pure liquids, but as well flowable slurries such as the calcium carbonate slurry mentioned above.) The perforations in these sieve trays are commonly in the form of simple round holes of a diameter that is deemed appropriate for the intended materials being reacted. However while it is important to provide via the tray openings a large ratio between the open and closed space on the perforated surface, it is also important to preserve the integrity of the tray from a strength viewpoint. This is particularly important where higher gas velocities are used in the tower, as is often desired for maximum efficacy and efficiency.

SUMMARY OF INVENTION

Now in accordance with the present invention a sieve tray is disclosed for use in a gas treatment tower, wherein the openings thereof are hexagonal in shape, enabling a higher open area in the tray while maintaining the tray structural integrity, thereby enabling use of the tray in higher velocity towers. The openings are arranged in rows and columns on the tray and each hexagonal opening is oriented with respect to each of its neighboring hexagonal openings so that opposed flat sides of neighboring openings are parallel. Consequently the closed area of the tray defined between the flat sides of the neighboring openings is a continuous strip of constant width corresponding to the distance between the adjacent flat sides of neighboring openings. The open area in the perforated surface of the tray can be as much as 60% of the total perforated surface, without sacrificing the mechanical integrity of the surface, a result that is not readily achievable where conventional round openings are provided.

The invention is also to be regarded as an improvement in the method for effecting a liquid-gas or slurry-gas reaction by flowing the gas through a tower in countercurrent relationship to the liquid or slurry which reacts with the gas or a component of the gas; and wherein one or more perforated sieve trays are mounted in the tower flow path to serve as liquid-gas or slurry-gas contact surfaces facilitating the liquid-gas or slurry-gas reaction. This method is thus improved by utilizing as the one or more sieve trays, a tray or trays having perforated openings which are hexagonal in shape, enabling in comparison to the perforations being round holes, a higher open area in the tray while better maintaining the tray structural integrity, thereby enabling higher velocities to be utilized for the gas and liquid or slurry flows.

BRIEF DESCRIPTION OF DRAWINGS

The invention is diagrammatically illustrated, by way of example, in the drawings appended hereto, in which.

DESCRIPTION OF PREFERRED EMBODIMENTS

Figure 1B:
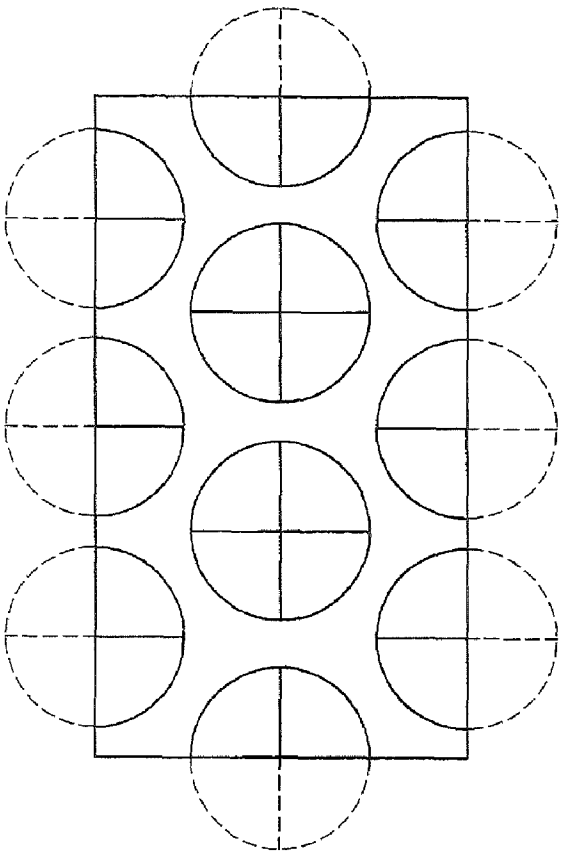
FIGS. 1(*a*) and 1(*b*) are plan views, schematic in nature, of the perforated surfaces of prior art sieve trays, respectively having 50% and 56% open area, wherein conventional round openings are provided.
Figure 1A:
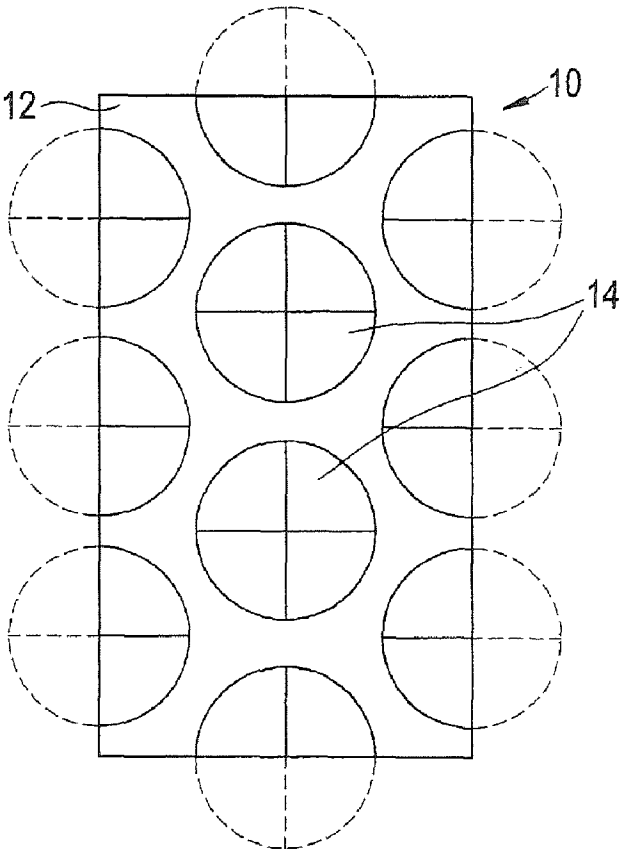

FIGS. 1(*a*) and 1(*b*) schematically depict the surface 12 of a typical prior art sieve tray 10, which is provided with a plurality of conventional circular openings 14. At FIG. 1(*a*) a 50% open surface is shown; and at FIG. 1(*b*) a 56% open area. Note in FIG. 1(*a*) that with the 1⅜ inch openings shown, the minimum distance between openings 14 is ⅜ inches, while in FIG. 1(*b*) the minimum distance between openings 14 is reduced to ¼ inch. Note as well that the solid strip 14 defined between the openings varies in shape depending upon the point in the strip which is considered.

Figure 2B:
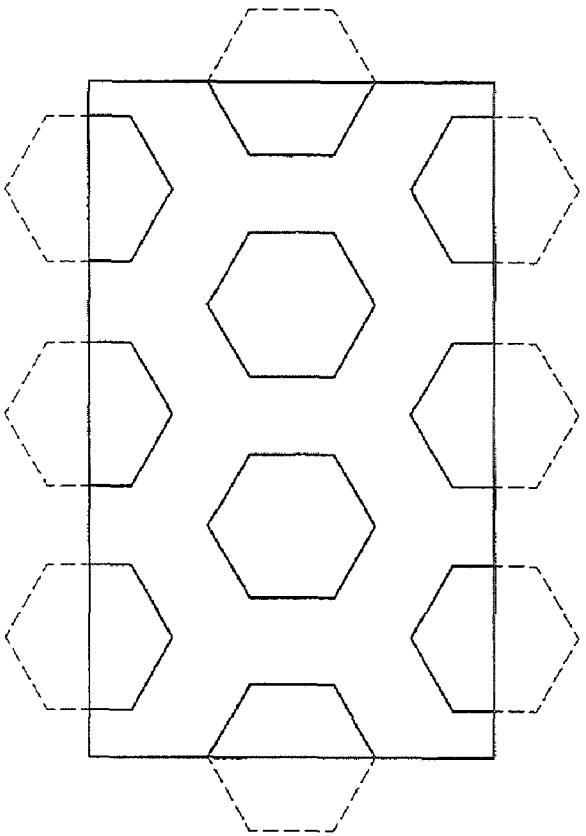
FIGS. 2(*a*) and 2(*b*) are plan views, schematic in nature, of the perforated surfaces of sieve trays, respectively having 50% and 56% open area; where the surfaces, in accordance with the invention, are provided with hexagonally formed openings.
Figure 2A:
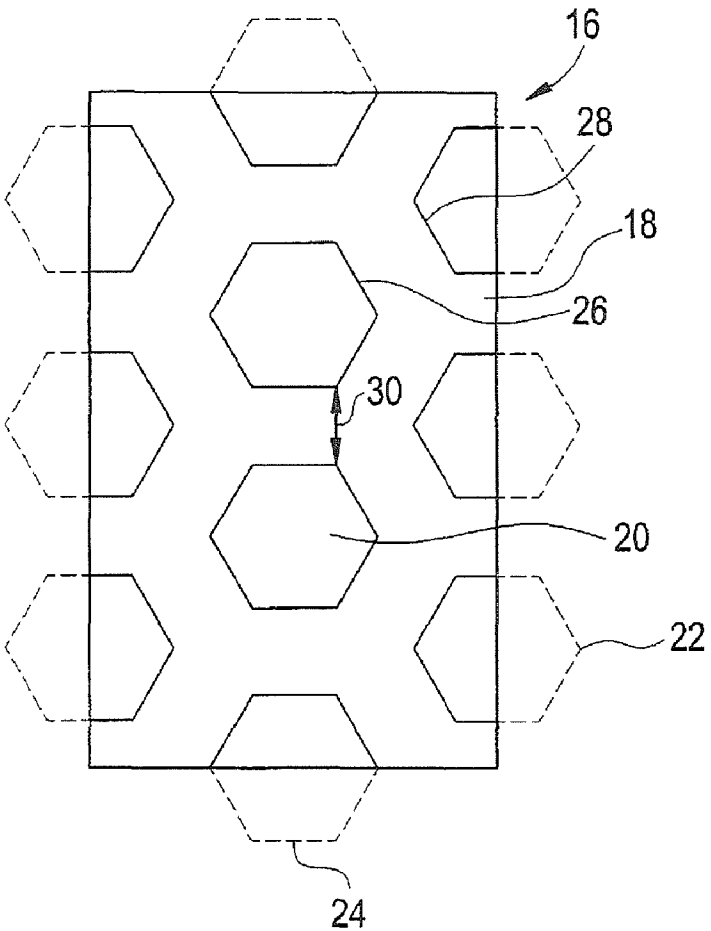

FIGS. 2(*a*) and 2(*b*) schematically depict the surface 18 of a sieve tray 16 which in accordance with the invention is provided with a plurality of hexagonally shaped openings 20. Openings 20 are seen to be arranged into rows 22 and columns 24. Each hexagonal opening is oriented with respect to each of its neighboring hexagonal openings so that opposed flat sides, e.g. 26 and 28, of neighboring openings are parallel. The closed area of tray 16 defined between the flat sides of the neighboring openings is a continuous strip 30 of constant width corresponding to the distance between the adjacent flat sides of neighboring openings.

The advantages gained by the invention will now be clear. Thus in FIG. 2(*a*) a 50% open area surface is shown. The flat sides of the hexagons are exemplarily shown as 13/16 inches. The distance between the closest points of neighboring openings is ⅝ inches—considerably greater than the corresponding parameter in FIG. 1(*a*). In FIG. 2(*b*) a 56% open area surface is shown. Here it is seen that the closest distance between the openings is ½ inch, again considerably greater than the corresponding approach distance in FIG. 1(*b*). Thus it will be evident that in comparison to the prior art use of round openings, the present invention results in considerably increasing the mechanical strength and integrity of the sieve tray in instances where the open area remains the same. This in turn enables use of sieve trays with greater open area, e.g.

in towers characterized by higher gas velocities, or enables safe increase of the gas velocity in a tower previously operated at a lower gas flow rate.

It will be appreciated that the dimensions shown in the Figures just discussed, are merely set forth to enable comparisons, and are not intended to delimit the present invention. It will also be appreciated that in these Figures shadow lines are use to visually complete the imaginary portions of the circular or hexagonal openings which would reside outside the periphery of the sieve tray. The shadowed portions thus depicted do not therefore represent real structure, but are simply provided to assist the viewer in understanding the invention.

While the present invention has been particular set forth in terms of specific embodiments thereof, it will be understood in view of the present disclosure, that numerous variations on the invention are now enabled to those skilled in the art, which variations yet reside within the scope of the present teaching. Accordingly, the invention is to be broadly construed and limited only by the scope and spirit of the disclosure and of the claims now appended hereto.

The invention claimed is:

1. For use in a gas treatment tower, a sieve tray consisting essentially of a flat plate having a plurality of hexagonally shaped openings, wherein the said openings are arranged in rows and columns on said plate, each hexagonal opening being oriented with respect to each of its neighboring hexagonal openings so that opposed flat sides of said neighboring openings are parallel, whereby the closed area of said plate defined between the flat sides of said neighboring openings is a continuous strip of constant width corresponding to the distance between the adjacent flat sides of neighboring openings enabling a higher open area on said plate while maintaining the tray structural integrity, thereby enabling use of the tray in higher velocity towers; and wherein the said open area in said tray is from 50 to 60% of the total plate area.

2. A gas-liquid/slurry contact tray for mounting in the flow path of FGD towers, consisting essentially of a flat plate including openings for passage of and contact between a gas and counterflowing liquids or slurries; said openings being hexagonally shaped, and arranged in rows and columns on said plate, each hexagonal opening being oriented with respect to each of its neighboring hexagonal openings so that opposed flat sides of neighboring openings are parallel, whereby the closed area of said plate defined between the flat sides of said neighboring openings is a continuous strip of constant width corresponding to the distance between the adjacent flat sides of neighboring openings, said openings providing a high open area in the tray while maintaining the tray structural integrity, thereby enabling higher velocities to be utilized for the gas and liquid or slurry flows in the tower; and wherein the said open area in said tray is from 50 to 60% of the total plate area.

3. In a gas treatment tower wherein a gas is flowed through the tower in countercurrent relationship to a liquid or slurry which reacts with the gas or a component of the gas; and wherein one or more perforated sieve trays are mounted in the tower flow path to serve as liquid-gas or slurry-gas contact surfaces facilitating the liquid-gas or slurry-gas reaction; the improvement wherein said one or more sieve trays consist essentially of: a flat plate having perforated openings which are hexagonal in shape and arranged in rows and columns on said plate, each hexagonal opening being oriented with respect to each of its neighboring hexagonal openings so that opposed flat sides of neighboring openings are parallel, whereby the closed area of said tray defined between the flat sides of said neighboring openings is a continuous strip of constant width corresponding to the distance between the adjacent flat sides of neighboring openings, enabling in comparison to the perforations being round holes, a higher open area in the tray while better maintaining the tray structural integrity, thereby enabling higher velocities to be utilized for the gas and liquid or slurry flows in the tower and wherein the open area provided on said tray by said perforations is from 50 to 60% of the total plate area.

4. In the method for effecting a liquid-gas or slurry-gas reaction by flowing said gas through a FGD tower in countercurrent relationship to said liquid or slurry which reacts with the gas or a component of the gas; and wherein one or more perforated sieve trays are mounted in the tower flow path to serve as liquid-gas or slurry-gas contact surfaces facilitating the liquid-gas or slurry-gas reaction; the improvement comprising:

utilizing as each of said one or more sieve trays a tray consisting essentially of a plate having perforated openings which are hexagonal in shape and arranged in rows and columns on said plate, each hexagonal opening being oriented with respect to each of its neighboring hexagonal openings so that opposed flat sides of neighboring openings are parallel, whereby the closed area of said plate defined between the flat sides of said neighboring openings is a continuous strip of constant width corresponding to the distance between the adjacent flat sides of neighboring openings, enabling in comparison to the perforations being round holes, a higher open area in the tray while better maintaining the tray structural integrity, thereby enabling higher velocities to be utilized for the gas and liquid or slurry flows in the tower; and wherein the open area provided on said tray by said perforations is from 50 to 60% of the total plate area.

* * * * *